US005377821A

United States Patent [19]

Fierek

[11] Patent Number: 5,377,821

[45] Date of Patent: Jan. 3, 1995

[54] CARTON WITH FLAG FOR DISPLAYING MERCHANDISE

[75] Inventor: Robert W. Fierek, Duluth, Minn.

[73] Assignee: Portable Products, Inc., St. Paul, Minn.

[21] Appl. No.: 111,718

[22] Filed: Aug. 25, 1993

[51] Int. Cl.[6] ..... G09F 3/00; B65D 73/00; B65D 5/50

[52] U.S. Cl. ..... 206/44 R; 206/459.5; 40/312

[58] Field of Search ..... 206/44, 459.5; 40/312; 229/103

[56] References Cited

U.S. PATENT DOCUMENTS

| | | | |
|---|---|---|---|
| 414,450 | 11/1889 | Schwartz | 40/312 X |
| 1,422,529 | 7/1922 | Bingaman | 40/312 |
| 1,926,299 | 9/1933 | Monk | 206/459.5 X |
| 2,134,971 | 11/1938 | Guyer | 40/312 X |
| 2,136,797 | 11/1938 | Lee | 40/312 X |
| 2,914,236 | 11/1959 | Shapiro | 206/44 |
| 3,099,381 | 7/1963 | Meyers | 206/459.5 |
| 3,254,824 | 6/1966 | Lang | 40/312 X |
| 3,292,290 | 12/1966 | Potter | 40/312 X |
| 4,756,409 | 7/1988 | Murray | 206/459.5 |

FOREIGN PATENT DOCUMENTS

| | | | |
|---|---|---|---|
| 681562 | 2/1930 | France | 206/44 |
| 340037 | 12/1930 | United Kingdom | 206/44 |
| 341977 | 1/1931 | United Kingdom | 206/44 |

*Primary Examiner*—William I. Price

*Attorney, Agent, or Firm*—Merchant, Gould, Smith, Edell, Welter & Schmidt

[57] ABSTRACT

An apparatus for displaying merchandise. The apparatus comprises a carton having a bottom and first and second adjacent sides. The first side defines a hole. The apparatus further comprises an arm having a hinge edge and a mutually exclusive periphery edge, the hinge edge is hingedly connected to the first side. The arm has a packing position and an operable position and is movable from the packing position to the operable position. When in the packing position, the arm is positioned within the hole, and the periphery edge is connected to the first side in intermittent intervals thereby forming a perforation between the arm and the first side. When in the operating position, the arm is substantially parallel to the first side and substantially perpendicular to the second side, thereby projecting from the carton. Sill further, the arm has first and second portions. The first and second portions are hingedly connected along a fold line. The first portion is movable between an extended position and a folded position. A first tab is operably connected to the box and a second tab is operably connected to the arm. The first and second tabs are interlockable, thereby securing the arm in the operable position. A third tab is operably connected to the arm and is interlockable with the first and second tabs. The third tab is for securing the first portion in the folded position.

6 Claims, 1 Drawing Sheet

CARTON WITH FLAG FOR DISPLAYING MERCHANDISE

TECHNICAL FIELD

The present invention relates generally to a carton for displaying merchandise, and more particularly to a carton that has an integrally formed arm that is capable of being folded into a position wherein it is projecting away from the carton.

BACKGROUND

As competition becomes more intense, the problem of capturing the attention of customers and distinguishing one's products from those of a competitor becomes an important and pressing issue. One way to distinguish products from those of a competitor is to package them in colorful and creative cartons. However, this technique is often ineffective because the cartons are placed on a department store shelf next to other products that are also packaged in colorful cartons. An additional problem is that the merchandise is often set at the back of a shelf, away from the aisle and out of a consumer's direct line of sight.

A second technique for capturing customers attention is to place merchandise on stand-alone displays that are set at the end of or in the middle of department store aisles. This technique is problematic because there are limited spaces at the end of aisles to place such stand-alone displays. Moreover, many stores may be reluctant to place displays in positions where they obstruct the traffic pattern of consumers and are easily knocked over.

A third approach to distinguishing one's products from those of a competitor is to place them in a large carton and hang some eye-catching accessory such as a flag on the front of the carton so that it projects from the shelf and into an aisle. This approach is problematic because the accessories are generally a separate piece from the carton and result in additional expenses. Moreover, these accessories tend to be flimsy and cannot support any weight. Consequently, merchandise cannot be displayed in the direct line of sight of consumers by hanging them from the accessory.

Therefore, there is a need for a carton that holds merchandise on a store shelf and attracts a customer's attention. There is also a need for a carton that can be used on any shelf and does not require additional eye-catching accessories to be attached thereto.

SUMMARY

The advantage of the present invention is that it provides a carton for displaying merchandise with an arm that extends into the aisle of a store and thus into the direct line of sight of a customer. A further advantage of the present invention is that it has the structural integrity to support hanging merchandise. Still further the present invention minimizes the need for a flag that is separate from the carton used to display merchandise.

More specifically, the present invention is an apparatus for displaying merchandise. The apparatus of the present invention comprises a carton having a bottom and first and second adjacent sides. The first side defines an aperture. The apparatus further comprises an arm having a hinged edge and a mutually exclusive periphery edge, the hinged edge being connected to the first side.

The arm has a packing position and an operable position and is movable from the packing position to the operable position. When in the packing position, the arm is positioned within the aperture or hole, and the peripheral edge is connected to the first side in intermittent intervals thereby forming a perforation between the arm and the first side. When in the operating position, the arm is substantially parallel to the first side and substantially perpendicular to the second side, thereby projecting from the carton.

Sill further, the arm has first and second portions. The first and second portions are hingably connected along a fold line. The first portion is movable between an extended position and a folded position.

A first tab is operably connected to the box and a second tab is operably connected to the arm. The first and second tabs are interlockable, thereby securing the arm in the operable position. A third tab is operably connected to the arm and is interlockable with the first and second tabs. The third tab is for securing the first portion in the folded position.

These and other advantages and features, which characterize the present invention, are pointed out with particularity in the claims annexed hereto and forming a further part hereto. However, for a better understanding of the invention, its advantages, and objects obtained by its use, reference should be made to the drawings that form a further part hereto and to the accompanying descriptive matter, which illustrates and describes a preferred embodiment of the present invention.

DETAILED DESCRIPTION OF THE DRAWINGS

DETAILED DESCRIPTION

Figure 1:
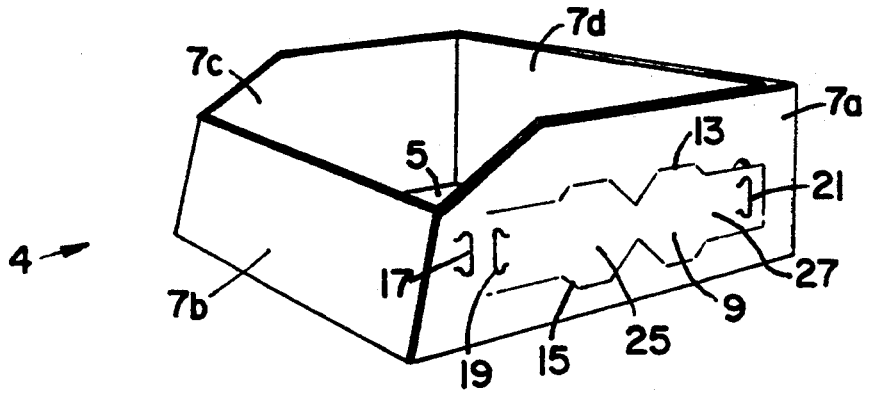
FIG. 1 is a perspective view of the display carton with the arm in the packing position.

A preferred embodiment of the invention will be described in detail with reference to the drawings, wherein like reference numerals represent like parts and assemblies throughout the several views. Reference to the preferred embodiment does not limit the scope of the invention, which is limited only by the scope of the claims interpreted according to the Doctrine of Equivalents.

Figure 2:
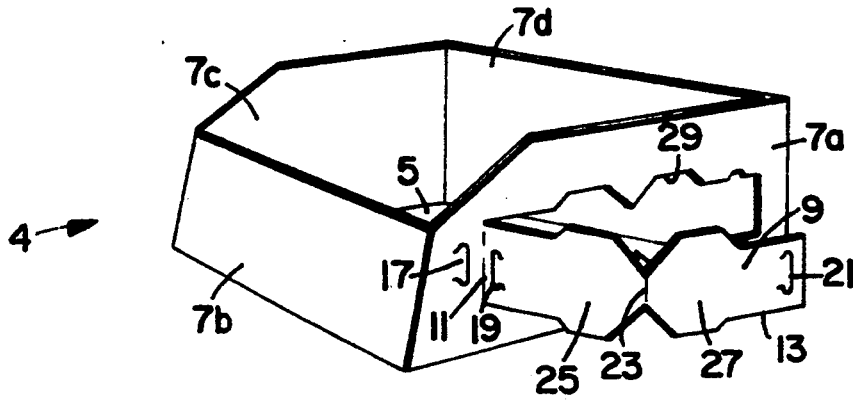
FIG. 2 is a perspective view of the carton as shown in FIG. 1 with the arm in a partially extended position.
Figure 3:
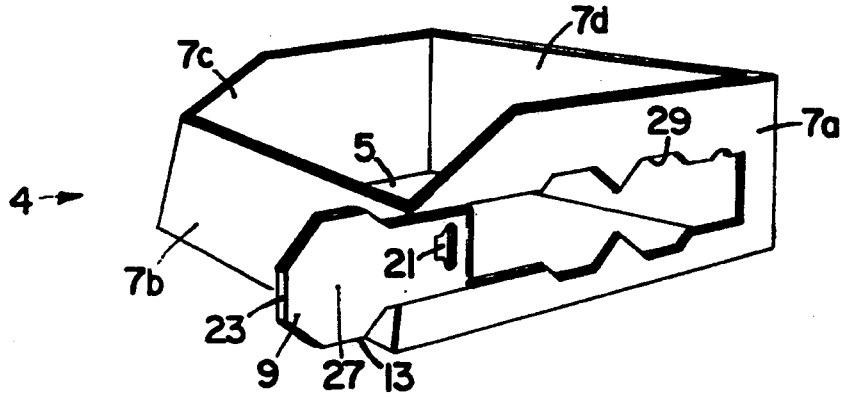
FIG. 3 shows the carton shown in FIG. 1 with the arm in the operational position.

Referring now to the figures, there is illustrated preferred embodiments of a carton, generally shown as 4, that includes the principles of the present invention. As shown in FIGS. 1, 2, and 3, the carton 4 has a bottom 5 and four sides *7a*, *7b*, *7c*, and *7d*. An arm 9 has a hinged edge 11 and a periphery edge 13. Hinged edge 11 is connected to side *7a* so that arm 9 may rotate around hinge edge 11 as shown in FIGS. 2 and 3. Hinged edge 11 and periphery edge 13 are mutually exclusive and circumscribe arm 9. Carton 4 and arm 9 are preferably made of corrugated cardboard. However, other materials suitable for packing cartons may be used.

Arm 9 has a packing position as shown in FIG. 1 and an operational position as shown in FIG. 3. Arm 9 is in the packing position while packing and shipping carton 4, and during all steps prior to the final display of carton 4 on store shelves. Referring now to FIG. 1, when arm 9 is in the packing position, periphery edge 13 forms an integral part of side 7*a*. In this position, a perforation 15 outlines second edge 13. Perforation 15 enables periphery edge 13 to be separated from side 7*a*, thereby permitting arm 9 to rotate around hinge edge 11. Hole 29 is formed when arm 9 is separated from side 7*a*. In an alternative embodiment, arm 9 may be merely placed within hole 29 without periphery edge 13 being attached to side 7*a*. Thus, there is no perforation formed between periphery edge 13 and side 7*a* when arm 9 is in the packing position. FIGS. 1–3 illustrate a preferred embodiment of a shape for arm 9. However, the shape of the arm 9 may take any form, such as the form or shape of the merchandise being sold.

Side 7*a* has a tab 17, and arm 9 has tabs 19 and 21. Arm 9 further has fold line 23, which divides arm 9 into a first portion 25 and a second portion 27.

When arm 9 is in the operational position as shown in FIG. 3, arm 9 is rotated around hinge edge 11 so that it is parallel to side 7*a* and is perpendicular to side 7*b*. Arm 9 is then folded along fold line 23 so that second portion 27 lies against first portion 25. Interlocking tabs 17 and 19 hold arm 9 in an extended position that is parallel to side 7*a* and perpendicular to side 7*b*. Interlocking tab 21 to tabs 17 and 19 holds second portion 27 against first portion 25. Thus, arm 9 is held in operational position by interlocking tabs 17, 19, and 21. The preferred embodiment utilizes tabs 17, 19 and 21 to secure the arm 9 in its operational position. One skilled in the art will appreciate that other means of securement may include adhesives, tape, clips, pins, and the like, which could hold arm 9 in the operational position. One skilled in the art will further appreciate that multiple arms could be employed in a single carton.

When in use, carton 4 is placed on a shelf so that arm 9 is positioned to project into the aisle of a store. Merchandise may then be placed in carton 4. When a customer walks down an aisle, arm 9 will be extending into the customer's direct line of sight and draw the customer's attention to the merchandise within the carton 4. In order to draw additional customer attention, merchandise may be secured to arm 9 so that the actual merchandise is within the customer's direct line of sight. Such a direct display of merchandise offers the customer the benefit of viewing merchandise without having to turn and face the shelves. Further, portions 25 and 27 form an incomplete octagon, which may be colored red, akin to a stop sign. One skilled in the art will appreciate that portions 25 and 27 may form other shapes and have different colors. One skilled in the art will further appreciate that it is not necessary that first portion 25 and second portion 27 have the same shape or color.

While the invention has been described in conjunction with a specific embodiment thereof, it is evident that different alternatives, modifications, and variations will be apparent to those skilled in the art in view of the foregoing description. Accordingly, the invention is not limited to these embodiments or the use of elements having specific configurations and shapes as presented herein.

I claim:

1. An apparatus for displaying merchandise, the apparatus comprising:

a) a carton for the display of merchandise having a bottom and at least one side;

b) at least one arm having a hinged edge and a mutually exclusive periphery edge, the hinged edge hingably connected to the carton, wherein the arm has a packing position and an operable position, the arm being moveable from the packing position to the operable position thereby causing the arm to project from at least one side of the carton and form a flag; and c) a means for securing the arm in the operable position comprising a first tab operably connected to the box and a second tab operably connected to the arm, the first and second tabs being interlockable thereby securing the arm in the operable position.

2. An apparatus for displaying merchandise, the apparatus comprising:

a) a carton for the display of merchandise having a bottom and at least one side;

b) at least one an arm having a hinged edge and a mutually exclusive periphery edge, the hinged edge hingably connected to the carton, wherein the arm has a packing position and an operable position, the arm being moveable from the packing position to the operable position thereby causing the arm to project from at least one side of the carton and form a flag, the arm having first and second portions, the first and second portions being hingedly connected along a fold line, the first portion being movable between an extended position and a folded position; and c) a means for securing the arm in the operable position.

3. The apparatus of claim 2 wherein the means for securing comprises a first tab operably connected to the box, a second tab operably connected to first portion, and a third tab operably connected to second portion, the first, second, and third tabs being interlockable thereby securing the arm in the operational position wherein the first portion is secured in the folded position.

4. The apparatus of claim 3 wherein the carton has first and second adjacent sides and the arm is hingedly connected to the first side, further wherein the arm is substantially parallel to the first side and substantially perpendicular to and projecting away from the second side, thereby projecting outward from the carton when in the operable position.

5. The apparatus of claim 4 wherein the first side defines an aperture and the arm is positioned within the hole when in the packing position, further wherein the peripheral edge of the arm is connected to the first side in intermittent intervals thereby forming a perforation between the arm and the first side.

6. An apparatus for displaying merchandise, the apparatus comprising:

a) a carton having a bottom and first and second adjacent sides, the first side defining an aperture;

b) an arm having a hinge edge and a mutually exclusive periphery edge, the hinge edge hingedly connected to the first side, wherein the arm has a packing position and an operable position, the arm being movable from the packing position to the operable position, the arm being positioned within the hole when in the packing position, and the arm being substantially parallel to the first side and substantially perpendicular to the second side, thereby projecting from the carton when in the operable position, further wherein the periphery edge is connected to the first side in intermittent intervals thereby forming a perforation between the arm and the first side when the arm is in the packing position, still further wherein the arm has first and second portions, the first and second portions being hingedly connected along a fold line, the first portion being movable between an extended position and a folded position;

c) a first tab operably connected to the box and a second tab operably connected to the arm, the first and second tabs being interlockable thereby securing the arm in the operable position; and d) a third tab operably connected to the arm, the third tab being interlockable with the first and second tabs, the third tab for securing the first portion in the folded position.

* * * * *